US006661315B2

(12) United States Patent
Iio

(10) Patent No.: US 6,661,315 B2
(45) Date of Patent: Dec. 9, 2003

(54) RESONATOR, FILTER, OSCILLATOR, DUPLEXER, AND COMMUNICATION APPARATUS

(75) Inventor: Kenichi Iio, Nagaokakyo (JP)

(73) Assignee: Murata Manufactuing Co. Ltd (JP)

( * ) Notice: Subject to any disclaimer, the term of this patent is extended or adjusted under 35 U.S.C. 154(b) by 16 days.

(21) Appl. No.: 09/800,322

(22) Filed: Mar. 6, 2001

(65) Prior Publication Data

US 2002/0021186 A1 Feb. 21, 2002

(30) Foreign Application Priority Data

Mar. 7, 2000 (JP) ..... 2000-061954

(51) Int. Cl.[7] ..... H01P 1/203; H01P 7/08; H01P 5/12

(52) U.S. Cl. ..... 333/219; 333/134; 333/204

(58) Field of Search ..... 333/202–205, 333/219, 134

(56) References Cited

U.S. PATENT DOCUMENTS

| | | | | |
|---|---|---|---|---|
| 3,760,302 A | * | 9/1973 | Cohn | 333/202 |
| 3,914,713 A | * | 10/1975 | Konishi et al. | 333/1.1 |
| 4,875,025 A | * | 10/1989 | Buoli | 333/219 |
| 5,825,263 A | * | 10/1998 | Falt | 333/204 |
| 6,023,206 A | * | 2/2000 | Henderson et al. | 333/204 |

FOREIGN PATENT DOCUMENTS

| | | |
|---|---|---|
| EP | 0524620 A2 | 1/1993 |
| EP | 0764996 | 3/1997 |
| EP | 0917236 A2 | 5/1999 |
| JP | 2000101304 A * | 4/2000 |

OTHER PUBLICATIONS

"CPW/Slotline Bandpass Filters with a Low Spurious Response", Konji Wada, et al., Sep. 9–12, 1996, Nexus Media, vol. CONF. 26, pp. 422 to 426.

"A Novel Split–Resonator High Power HTS Planar Filter", Shen Ye, et al., Jun. 1997, Symposium Digest, IEEE, pp. 299 to 302.

Patent Abstract of Japan vol. 014, No. 297; Jun. 27, 1990 & JP 02 096402 A (Matsushita Electric Ind Co Ltd), Apr.9, 1990.

Moraud S et al.: "A New Planar Type Dielectric Resonator for Microwave Filtering" IEEE MTT–S International Microwave Symposium Digest, US, New York, NY: Jun. 7, 1998, pp. 1307–1310.

Patent Abstract of Japan vol. 1998, No. 01, Jan. 30, 1998 & JP 09 246821 A (Murata MFG Co Ltd), Sep. 19, 1997.

Patent Abstract of Japan vol. 1995, No. 09, Oct. 31, 1995 & JP 09 154114 A (Murata MFG Co Ltd), Jun. 16, 1995.

* cited by examiner

*Primary Examiner*—Seungsook Ham
(74) *Attorney, Agent, or Firm*—Dickstein Shapiro Morin & Oshinsky LLP

(57) ABSTRACT

A resonator, a filter, an oscillator, a duplexer, and a communication apparatus employing these devices have improved efficiency characteristics in confining an electromagnetic field in an opening of an electrode, suppressed current concentration, and minimized conductor loss. Electrode patterns are formed near short-circuited positions in a slot so that the slot will be divided into smaller-width slot lines. Consequently, the efficiency in confining the electromagnetic field is improved, and conductor loss is minimized.

18 Claims, 13 Drawing Sheets

RESONATOR, FILTER, OSCILLATOR, DUPLEXER, AND COMMUNICATION APPARATUS

BACKGROUND OF THE INVENTION

1. Field of the Invention

The present invention relates to a resonator having an electrode formed on a dielectric substrate, a filter, an oscillator, a duplexer, and a communication apparatus employing these devices.

2. Description of the Related Art

Resonators formed using a dielectric substrate and designed to exhibit resonance in the frequency band of microwaves or millimeter waves include a resonator realized with a slot line.

In a conventional slot-line resonator, one resonator is realized with a straight half-wave slot line. Such a resonator realized with a slot line is structured to have an electrode continuously formed around a slot line, and can therefore confine electromagnetic energy in the slot line with high efficiency. When the resonator is included as a module in a high-frequency circuit, it hardly interferes with any other circuit. This is advantageous.

FIG. 18A and FIG. 18B show an example of a half-wave slot-line resonator having both ends thereof short-circuited. In FIG. 18A, an electrode 2 having a slot 3 bored as part thereof is formed on the upper side of a dielectric substrate 1. FIG. 18B shows the distribution of the electromagnetic field on the slot-line resonator. In FIG. 18B, solid lines denote the electric field and dashed lines denote the magnetic field.

The efficiency of the resonator realized with a slot line in confining the electromagnetic field depends on the width of the slot. In other words, the larger the width of the slot 3 (slot line), the wider the spread of the electromagnetic field in the slot-line resonator.

The foregoing phenomenon will be interpreted below from a physical viewpoint.

For example, the electric field distribution in a slotted section is as shown in FIG. 19A. When the electric field distribution is expressed as an equivalent circuit, the equivalent circuit is like that shown in FIG. 19B or FIG. 19C. FIG. 19B shows an equivalent circuit for a large-width slot, while FIG. 19C shows an equivalent circuit for a small-width slot. In the equivalent circuit, if the ratio of an electrostatic capacitance C2 (C2') or C3 (C3') to the total electrostatic capacitance is large, or in other words, if the electrostatic capacitance C2 (C2') or C3 (C3') contributes greatly to the total electrostatic capacitance, the spread of the electromagnetic field is thought to be wide. In contrast, if the ratio is small or if the electrostatic capacitance C2 (C2') or C3 (C3') contributes little, the degree of concentration of the electromagnetic field in the slot is thought to be high.

Assuming that the lengths of electric lines of force drawn to pass through points at which the electrostatic capacitances C1 (C1'), C2 (C2'), and C3 (C3') are detected are w1 (w1'), w2 (w2'), and w3 (w3'), respectively, the electrostatic capacitances are inversely proportional to the lengths of the electric lines of force.

The lengths of the electric lines of force drawn to pass through the points at which the electrostatic capacitances are detected are assumed to change from those shown in FIG. 19B to those shown in FIG. 19C. This signifies that the width of the slot is decreased by a length Δw. In this case, the following relationships are obtained:

$$w1'=w1-\Delta w$$

$$w2'=w2-\Delta w$$

$$w3'=w3-\Delta w$$

In addition, a relationship of w1<w2<w3 holds. Among the changes from the capacitances C1, C2, and C3 to the capacitances C1', C2', and C3', the change from C1 to C1' is the largest. Namely, when the width of the slot is small, the electrostatic capacitance C1 (C1') contributes most greatly to the total electrostatic capacitance. This means that a smaller width of a slot or a slot line leads to a higher degree of concentration of the electromagnetic field.

Therefore, for improving the efficiency of a slot-line resonator in confining the electromagnetic field, the width of a slot or a slot line should be decreased. A high-frequency circuit module is assumed to be composed of a slot-line resonator and another conductive line which are formed using a dielectric substrate. In this case, once the efficiency of the slot-line resonator in confining the electromagnetic field is improved, even if the distance from the slot-line resonator to the conductive line is decreased, undesirable coupling will hardly occur. The high-frequency circuit module can therefore be designed compactly.

When the width of a slot line in a slot-line resonator is decreased, the degree of current concentration at the edges of an electrode increases. Consequently, the edge effect becomes significant and conductor loss increases. The unloaded Q-factor (Qo) exhibited by the resonator decreases. Therefore, if the resonator is employed in a filter or the like, a new problem such as increased insertion loss will occur.

SUMMARY OF THE INVENTION

Addressing these problems, the present invention provides a resonator, a filter, an oscillator, a duplexer, and a communication apparatus employing these devices which exhibit improved efficiency in confining an electromagnetic field in an opening of an electrode, suppressed concentration of currents, and minimized conductor loss.

According to an aspect of the present invention, a resonator has a slot-like opening formed in a dielectric substrate. Electrode patterns are formed in the slot-like opening so that the slot-like opening will be divided into smaller-width slot lines. The electrode patterns by which the slot-like opening is divided into the smaller-width slot lines have a width permitting suppression of an edge effect occurring in the electrode patterns.

Owing to the above structure, since the slot lines into which the slot-like opening is divided by the electrode patterns have a small width, the efficiency in confining the electromagnetic field improves. Moreover, the resonator is structured to have a plurality of slot lines, which serve as resonators, juxtaposed and separated by the electrode patterns. The direction of a current flowing along one edge of each of the electrode patterns by which the slot-like opening is divided into the smaller-width slot lines is opposite to the direction of a current flowing along the other parallel edge thereof. The currents flow close to each other in mutually opposite directions. Therefore, loss hardly occurs in each electrode pattern. However, conductor loss occurs at both the edges of each electrode pattern. Assuming that resistors Ra and Rb cause the conductor loss at the edges of each electrode pattern, an unloaded Q-factor Qo exhibited by each slot line is expressed as $Qo=\omega L/(Ra+Rb)$. Since the plurality of slot lines is juxtaposed, ωL gets larger in proportion to the number of juxtaposed slot lines. This results in an improved unloaded Q-factor Qo.

Moreover, according to an aspect of the present invention, the electrode patterns are preferably formed only in short-circuited or equivalently short-circuited portions of the slot-like opening so that adjoining slot lines will communicate with a portion of the slot-like opening. Owing to this structure, conduction loss occurring in part of each electrode pattern which exhibits a high current density is minimized effectively. Moreover, the adjoining slot lines into which the slot-like opening is divided communicate with the portion of the slot-like opening devoid of the electrode patterns. Consequently, occurrence of a spurious pulse mode in each of the slot lines into which the slot-like opening is divided by the electrode patterns can be suppressed. Moreover, a portion of the slot-like opening in which the electrode patterns, by which the slot-like opening is divided into the smaller-width slot lines, are formed is so limited that the electrode patterns can be formed easily.

Moreover, according to an aspect of the present invention, the slot-like opening in the resonator is preferably shaped spirally. Consequently, currents flowing along edges formed between two adjoining lines of the slot lines, into which the spiral slot-like opening is divided, are canceled out. Conductor loss occurring at the edges between the slot lines can be minimized more effectively.

Preferably, a plurality of slot-like openings is juxtaposed in the resonator, and the width of each slot-like opening is made larger near an equivalently open position.

Electrode patterns are formed at short-circuited or equivalently short-circuited positions in each slot-like opening so that the slot-like opening will be divided into smaller-width slot lines, whereby the spread of the magnetic field is suppressed. When the slot-like openings are juxtaposed, the degree of coupling among the openings decreases. However, electric fields are dominant near the equivalently open position in each slot-like opening. Therefore, since the plurality of slot-like openings whose widths are each made larger near the equivalently open position is juxtaposed, the degree of coupling between adjoining slot-like openings can be increased.

Moreover, according to an aspect of the present invention, an electrode having an opening as part thereof may be formed on a dielectric substrate, and a plurality of electrode patterns may be extended inwards from the periphery of the opening so that a plurality of slot lines will be arranged substantially radially. The electrode patterns extended inwards have a sufficiently small width. The direction of a current flowing along one edge of each of the plurality of electrode patterns is opposite to the direction of a current flowing along the other edge thereof parallel to the one edge. Therefore, edge effects are canceled out. Moreover, since the slot lines are arranged substantially radially, each of the slot lines adjoins another slot line. The slot lines do not have an edge at which an edge effect occurs. Compared with a resonator realized with a single slot line, the overall conductor loss is suppressed.

According to an aspect of the present invention, a filter includes a resonator having any of the aforesaid structures, and a signal input/output port.

According to an aspect of the present invention, an oscillator is a band reflection type oscillator comprising a reflex amplification circuit and the aforesaid resonator.

According to the above aspect of the present invention, the stability in an oscillation frequency is improved by utilizing the property of a resonator that is a high unloaded Q-factor Qo.

According to an aspect of the present invention, a duplexer is provided with the aforesaid filter as a transmission filter and a reception filter respectively connected between a transmission signal input port and an input/output port used in common for transmission and reception, and between the input/output port used in common for transmission and reception and a reception signal output port.

According to an aspect of the present invention, a communication apparatus is provided with the aforesaid resonator, filter, oscillator, or duplexer.

According to the above aspect of the present invention, a communication apparatus having a small loss and exhibiting high efficiency in utilizing power is provided by making the most of the property of a resonator that is a high unloaded Q-factor Qo. Moreover, since a resonator, a filter, an oscillator, or a duplexer which can highly efficiently confine electromagnetic fields is adopted, these devices and other circuits or devices can be located close to each other. The communication apparatus can therefore be designed compactly.

Other features and advantages of the present invention will become apparent from the following description of embodiments of the invention which refers to the accompanying drawings, in which like references denote like elements and parts.

DETAILED DESCRIPTION OF EMBODIMENTS OF THE INVENTION

Referring to FIG. 1A to FIG. 4B, the structure of a resonator in accordance with a first embodiment will be described below.

Figure 1A:
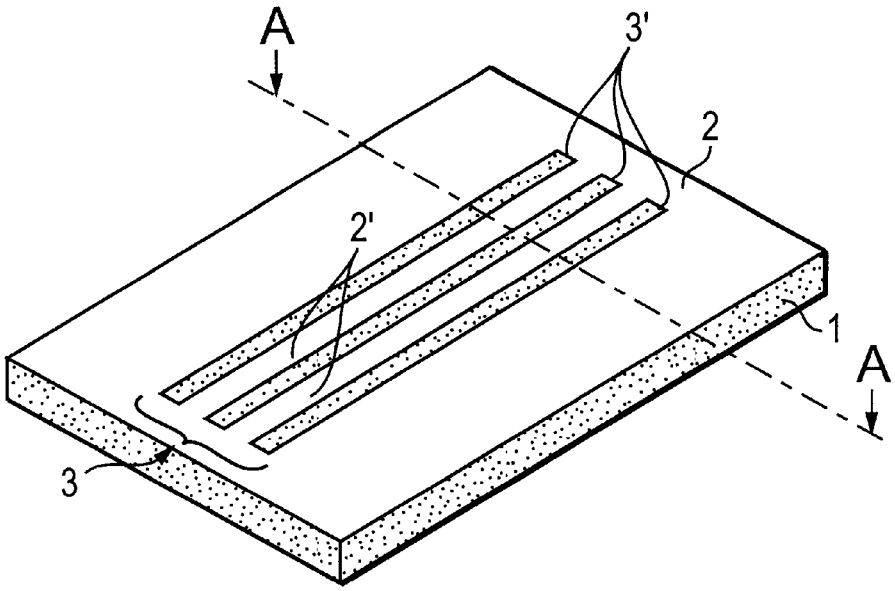
FIG. 1A and FIG. 1B show the structure of a resonator in accordance with a first embodiment of the present invention.
Figure 1B:
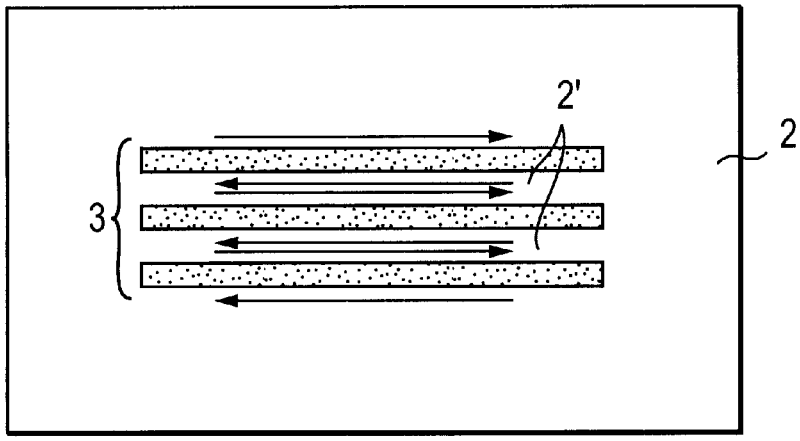

FIG. 1A is a perspective view of a resonator, and FIG. 1B is a plan view showing an example of the current distribution. Referring to the drawings, a dielectric substrate 1 has an electrode 2 formed on an upper side thereof, in which a rectangular slot 3 is machined. Electrode patterns 2' are formed so that the slot 3 is divided into smaller-width slot lines 3'. The slot lines 3' into which the slot 3 is finely divided by the electrode patterns 2' each operate as a half-wave resonator having both ends thereof short-circuited.

Figure 19A:
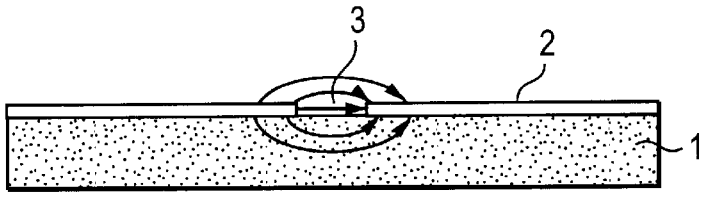
FIG. 19A PRIOR ART
FIG. 19A shows the electric field distribution in a slotted section and FIGS. 19B and 19C show equivalent circuits.
Figure 19B:
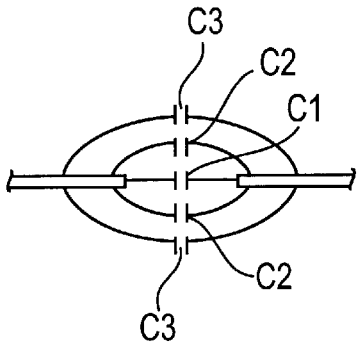
FIG. 19B PRIOR ART
Figure 19C:
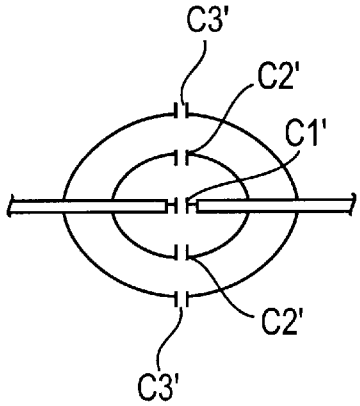
FIG. 19C PRIOR ART

Since the slot 3 in the resonator shown in FIG. 1 is divided into the slot lines 3' by the electrode patterns 2', the width of each slot line is smaller than that in the conventional resonator shown in FIG. 19A to FIG. 19C. Therefore, the resonator shown in FIG. 1 enjoys improved efficiency of confining the electromagnetic field.

Moreover, since the three slot lines into which the slot 3 of the resonator is divided by the electrode patterns 2' each operate as a half-wave resonator, the resonator can be said to have three half-wave resonators juxtaposed therein. The three half-wave resonators are thought to be mutually coupled. Consequently, current concentration is alleviated and conductor loss is minimized. As shown in FIG. 1B, the direction of a current flowing along one edge of each electrode pattern 2' is opposite to the direction of a current flowing along the other edge thereof. Current concentration at the edge is therefore alleviated. Consequently, almost no current flows through each electrode pattern 2'.

Figure 2:
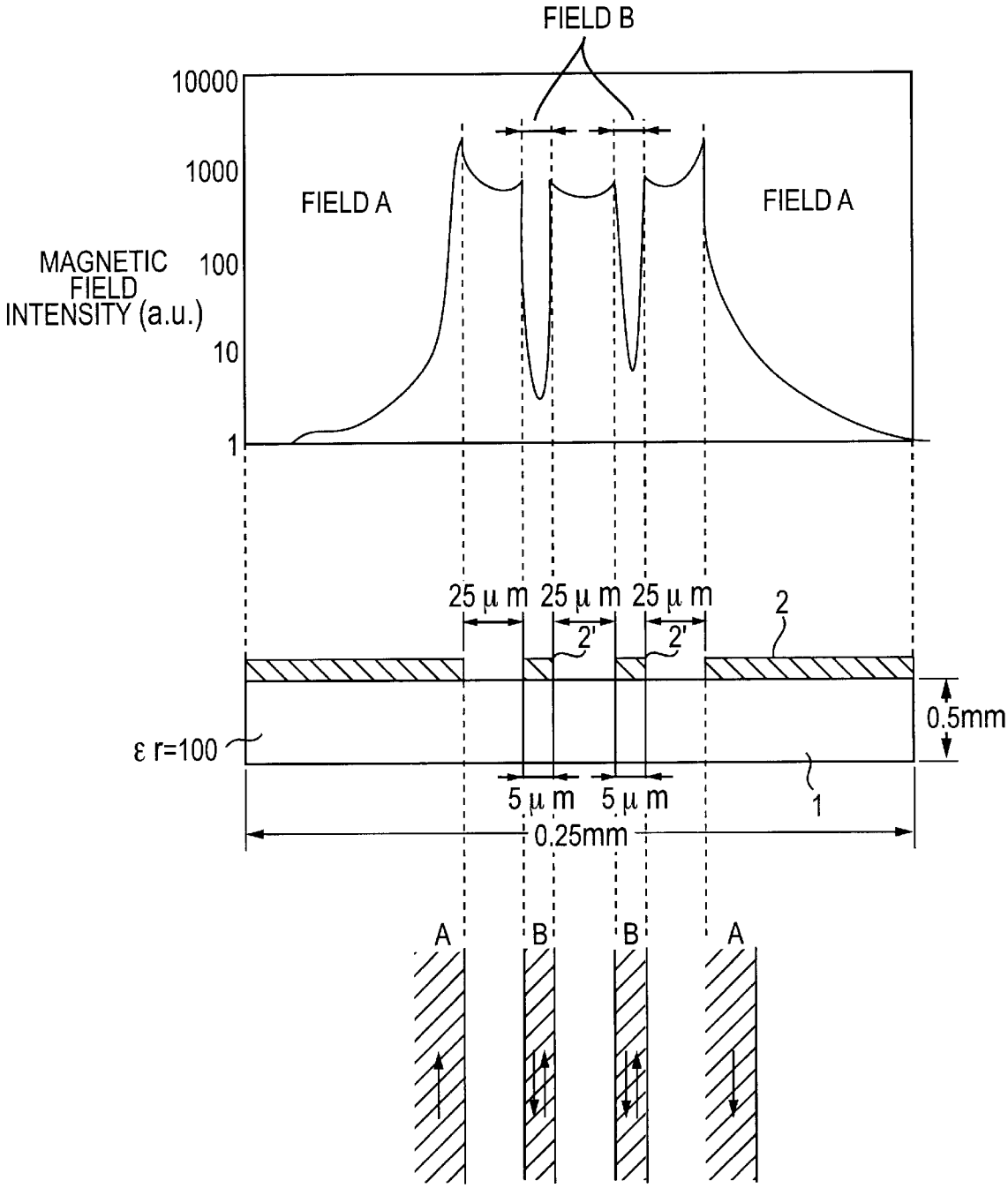
FIG. 2 shows an example of the magnetic field distribution across slot lines.

In an effort to demonstrate that currents flowing through the electrode patterns 2' are canceled out owing to the three parallel slot lines into which the slot 3 is divided, the distribution of magnetic field intensities was calculated using a finite element method (FEM). Referring to FIG. 2, the upper graph shows the distribution of magnetic field intensities, the middle diagram shows the slotted section of the resonator including the sections of the three parallel slot lines, and the lower diagram is a plan view of the slotted section. Assuming that electromagnetic waves that are in phase with one another are induced along the three slot lines, structural parameters were set to the values indicated in FIG. 2.

As is apparent from FIG. 2, currents are concentrated at the edges of the electrode patterns formed with the slot. The influence of the currents fades out sharply in proportion to the distance from the edges. As seen in FIG. 2, the electrode patterns, including the edges at which magnetic fields are concentrated, define fields B which are disposed between two adjoining slot lines and fields A in which the effect of the presence of the slot lines is reduced. Compared with the fields A, the concentration of the magnetic field sharply reduced in the fields B. The current density between the adjoining slot lines is therefore very low, and conductor loss occurring in the electrode patterns 2' is minimized drastically.

The foregoing advantage can be expected even when the number of electrode patterns is three or more.

According to the first embodiment, no electrode is formed on the lower side of the dielectric substrate. However, in an alternative embodiment, a ground electrode may be formed all over the lower side of the dielectric substrate. Moreover, as another alternative, an electrode having a slot and electrode patterns may be formed on the lower side of the dielectric substrate so that the slot and electrode patterns will be opposed (mirror-symmetric) to the slot 3 and electrode patterns 2' on the upper side thereof. In this case, the resonator operates as a resonator having a planar dielectric transmission line (PDTL), that is, having both the sides of the dielectric substrate sandwiched between the slots.

Next, the structure of a resonator in accordance with a second embodiment will be described with reference to FIG. 3A to FIG. 5B.

Figure 3A:
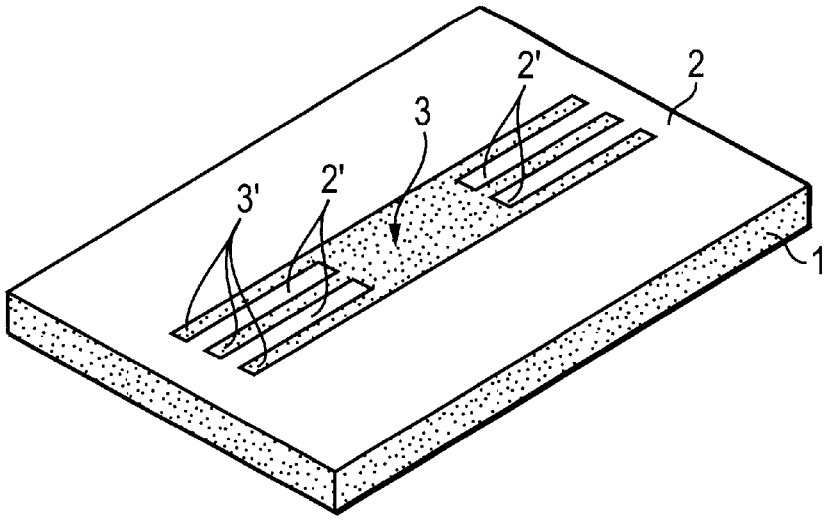
FIG. 3A and FIG. 3B show the structure of a resonator in accordance with a second embodiment.
Figure 3B:
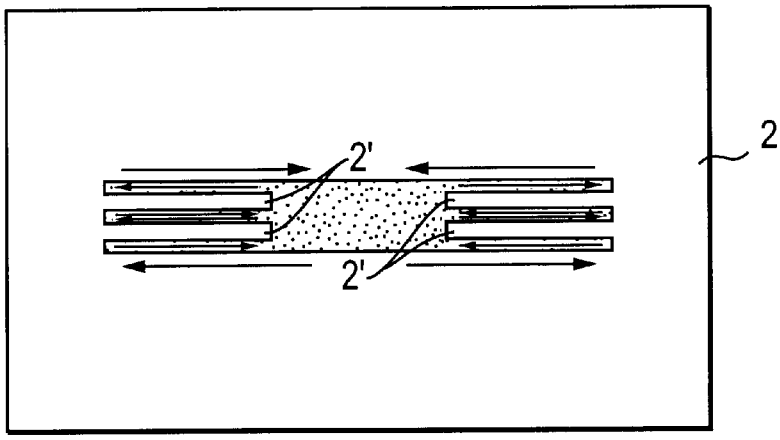

FIG. 3A is a perspective view of a resonator, and FIG. 3B is a plan view showing an example of the current distribution. In the drawings, a dielectric substrate 1 has an electrode 2 formed on the upper side thereof, in which a slot 3 is machined. Electrode patterns 2' are extended inwards from short-circuited ends or equivalently short-circuited ends of the slot 3 so that the electrode patterns 2' divide the slot 3 into slot lines 3'. The resonator operates as a half-wave resonator having both ends thereof short-circuited.

Incidentally, as the relative dielectric constant of the dielectric substrate is increased, the spread of the magnetic field near an equivalently open position in the slot is reduced. The spread of the magnetic field near each short-circuited end of the slot is therefore the major factor in deterioration of the efficiency of the resonator in confining the electromagnetic field. Therefore, the electrode patterns 2' are formed as shown in FIG. 3A and FIG. 3B so that the slot 3 will be divided into slot lines at least near the short-circuited ends thereof. Thus, the efficiency of the resonator in confining the magnetic field is improved.

Moreover, currents are concentrated near the short-circuited ends of the slot 3. Therefore, the electrode patterns 2' are formed as shown in FIG. 3A and FIG. 3B so that the slot 3 will be divided into slot lines at least near the short-circuited ends thereof. Consequently, current concentration is alleviated. Moreover, the direction of a current flowing along one edge of each of the electrode patterns 2' extended from the short-circuited ends of the slot is opposite to the direction of a current flowing along the other edge thereof. Therefore, almost no conductor loss occurs in the electrode patterns 2'. Consequently, the conductor loss occurring in the whole resonator is minimized.

In an effort to demonstrate that the efficiency in confining the electromagnetic field is improved in a slot 3 in which a plurality of thin slot lines 3' are formed by the electrode patterns 2' (FIG. 4A), the electromagnetic field distribution was simulated using an Ansoft simulator HFSS. A conventional slot-line resonator (FIG. 4B) was adopted as a comparative example.

Figure 4A:
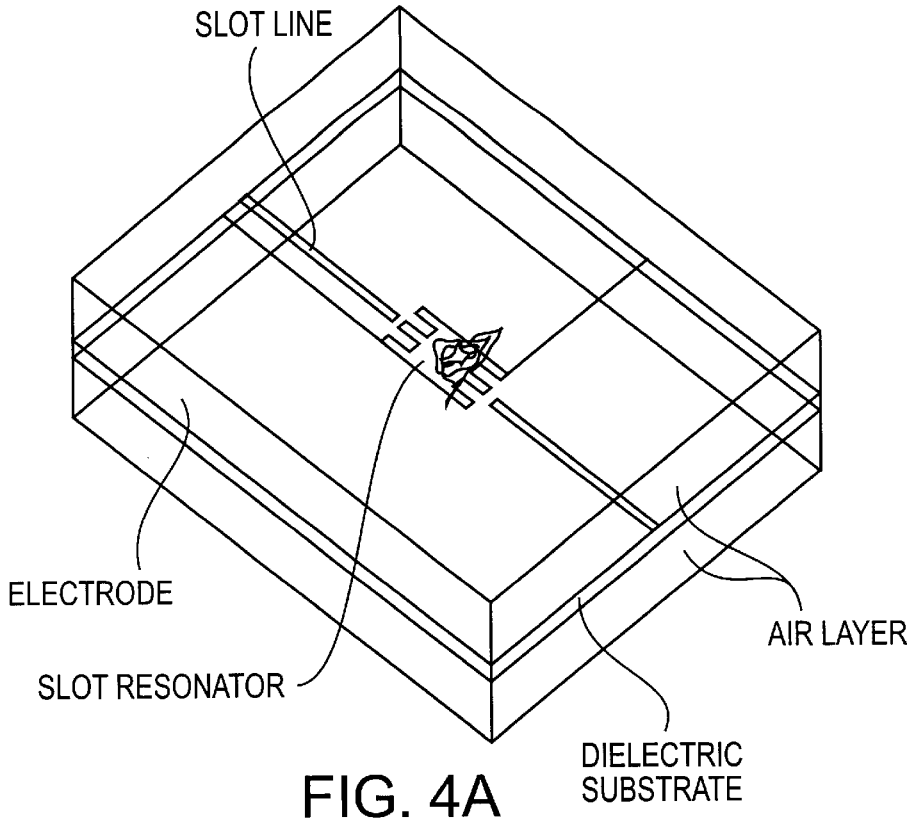
FIG. 4A and FIG. 4B show examples of distributions of magnetic field intensities observed in the resonator and a conventional resonator as a comparative example.
Figure 4B:
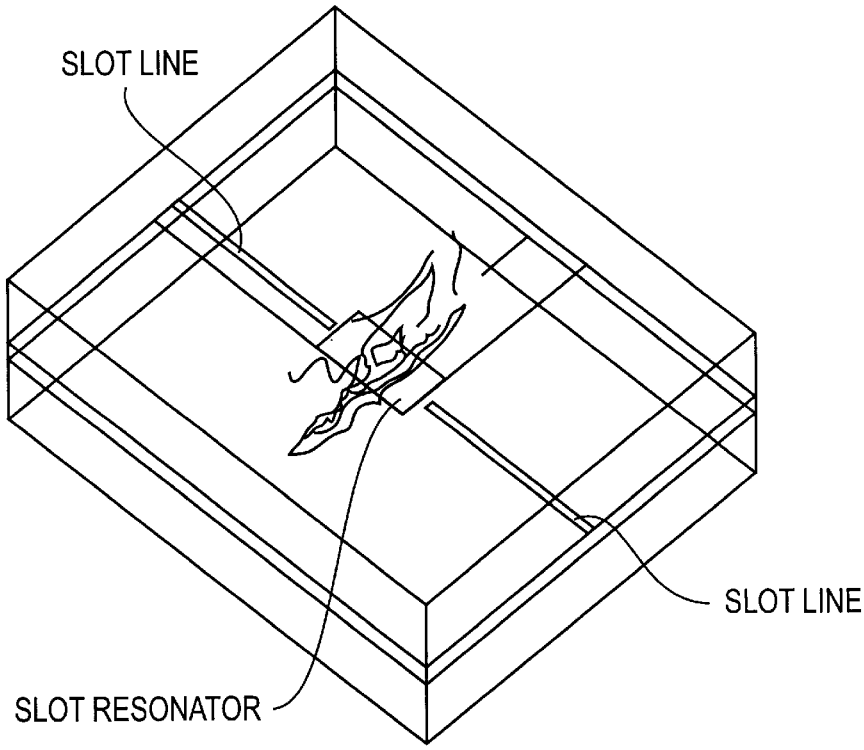
FIG. 4B PRIOR ART
Figure 5A:
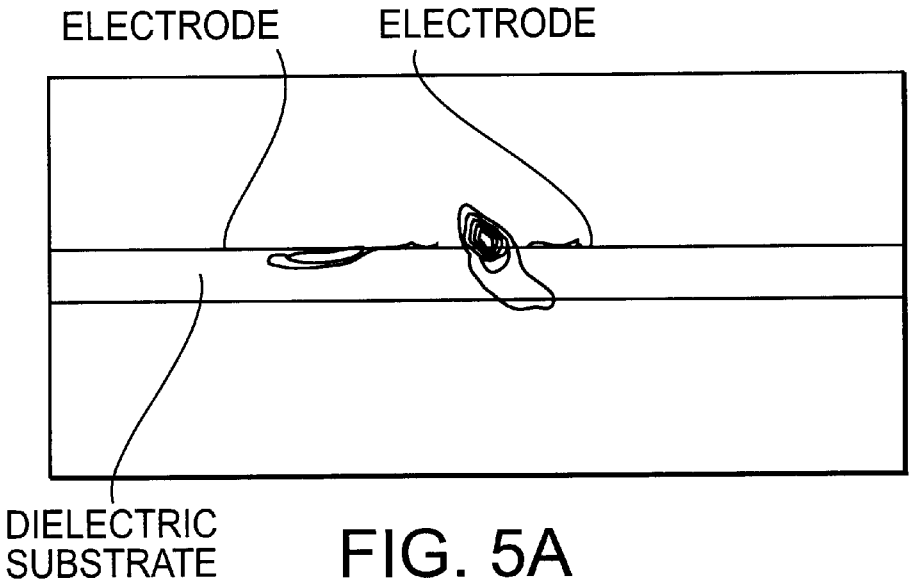
FIG. 5A and FIG. 5B are sectional views showing the distributions of magnetic field intensities.
Figure 5B:
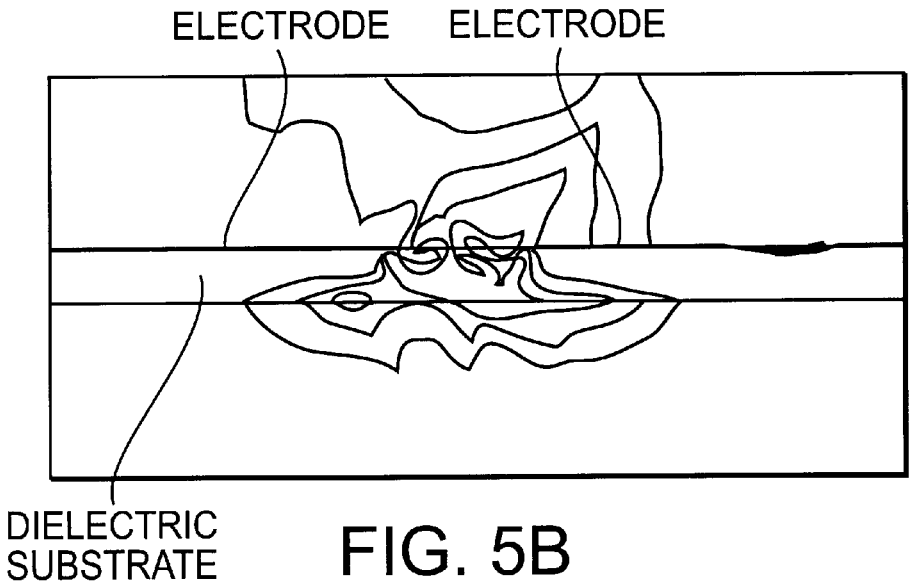

FIG. 4A and FIG. 4B are perspective views showing the magnetic field distribution with lines indicating equal magnetic field intensities. FIG. 5A and FIG. 5B are sectional views showing sections perpendicular to the direction in which the slot extends, showing magnetic field distributions with the lines indicating equal magnetic field intensities. FIG. 4A and FIG. 5A are concerned with the resonator in accordance with the second embodiment, while FIG. 4B and FIG. 5B are concerned with the conventional slot-line resonator. Herein, the thickness of the dielectric substrate is 0.6 mm, the relative dielectric constant thereof is 24, and the distance to an upper or lower shield plate placed parallel to the dielectric substrate is 1.0 mm. Moreover, the resonant frequency at which the resonator, with which FIG. 4A and FIG. 5A are concerned, exhibits resonance is 38 GHz. The resonant frequency at which the conventional resonator, with which FIG. 4B and FIG. 5B are concerned, exhibits resonance is 37.8 GHz.

As mentioned above, since the electrode patterns are formed to divide the slot into the slot lines in the width direction of the slot, the efficiency of the resonator in confining the electromagnetic field is improved.

When a plurality of slot lines into which the slot is divided by the electrode patterns 2' are juxtaposed, some spurious pulse modes may occur. However, the electrode patterns 2' are not extended to an equivalently open position in the slot. Therefore, spurious pulse modes that are out of phase are canceled out at the equivalently open position.

FIG. 3A and FIG. 3B, and other drawings show an example in which no electrode is formed on the lower side of the dielectric substrate. Alternatively, an electrode having a slot and electrode patterns may be formed on the lower side of the dielectric substrate so that the slot and electrode patterns will be opposed to the slot 3 and electrode patterns 2' formed on the upper side thereof. Thus, a resonator having a planar dielectric transmission line (PDTL) may be constructed.

Next, the structure of a resonator in accordance with a third embodiment will be described in conjunction with FIG. 6A to FIG. 6C.

Figure 6A:
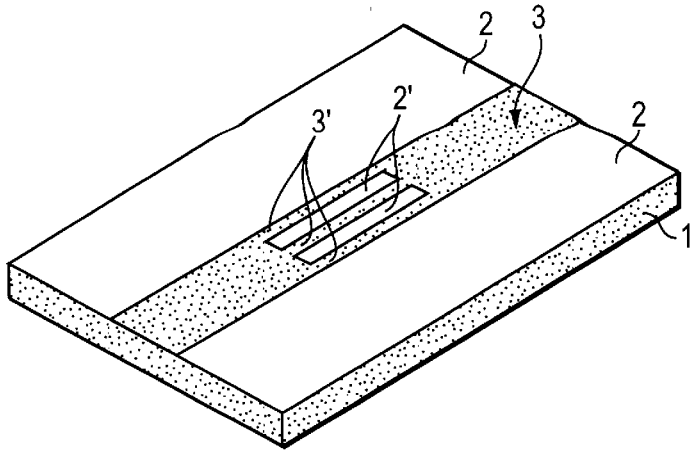
FIG. 6A to FIG. 6C show the structures of resonators in accordance with a third embodiment.

In an example shown in FIG. 6A, an electrode 2 having a slot 3 machined therein is formed on the upper side of a dielectric substrate 1. The slot 3 is open at both ends of the dielectric substrate 1, and operates as a half-wave resonator having both ends left open. However, electrode patterns 2' are formed in the center of the slot, that is, near an equivalently short-circuited position in the slot so that the slot 3 will be divided into smaller-width slot lines 3'. If the electrode patterns 2' were not present, the current density would be higher near the equivalently short-circuited position along the edges of the slot 3. However, since the electrode patterns 2' are formed at the equivalently short-circuited position, current concentration is alleviated in the same manner as that in the aforesaid embodiment. Consequently, the unloaded Q-factor Qo of the resonator can be improved. Moreover, the slot is divided into smaller-width slot lines by the electrode patterns 2', though only part of the slot is divided. Therefore, the efficiency in confining the electromagnetic field is improved.

Figure 6B:
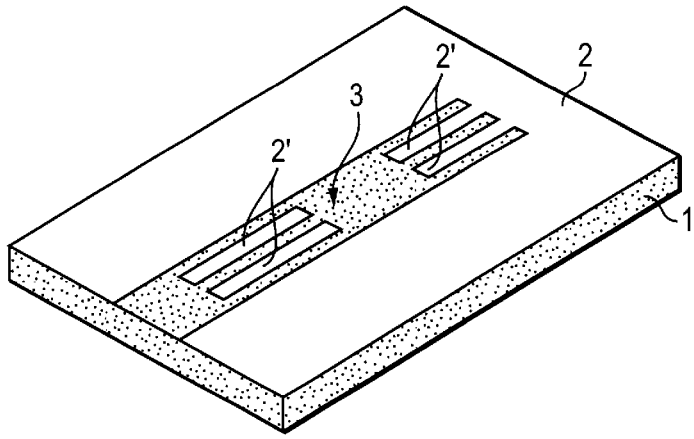

In an example shown in FIG. 6B, one end of the slot 3 is short-circuited, and the other end thereof is left open. The slot 3 thus operates as a three-quarter-wave resonator. Even in this example, electrode patterns 2' are formed near equivalently short-circuited positions in the slot so that the slot 3 will be divided into smaller-width slot lines. Consequently, the efficiency of the resonator in confining the electromagnetic field is improved without a decrease in the unloaded Q-factor Qo of the resonator.

Figure 6C:
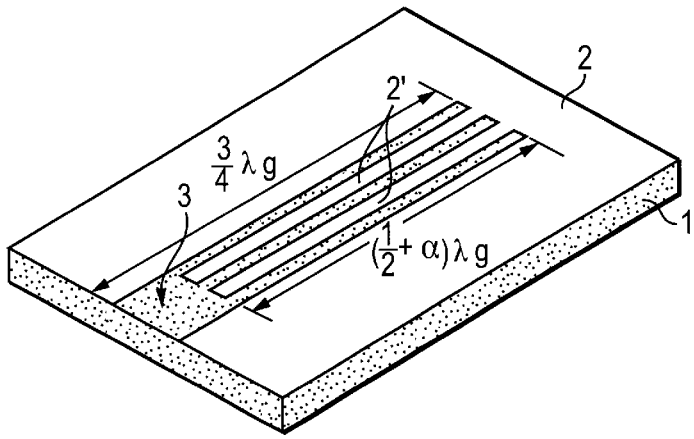

In an example shown in FIG. 6C, an electrode 2 having a slot 3 with one end short-circuited and the other end left open is formed on the upper side of a dielectric substrate 1. Electrode patterns 2' having a length $(\frac{1}{2}+\alpha)\lambda g$ are extended from the open end, where $\alpha$ denotes any value equal to or smaller than ¼. The electrode patterns 2' are equivalent to the two sets of electrode patterns 2' shown in FIG. 6B. Even when a resonator has this structure, the efficiency of the resonator in confining the electromagnetic field can be improved without a decrease in the unloaded Q-factor Qo thereof.

Figure 7:
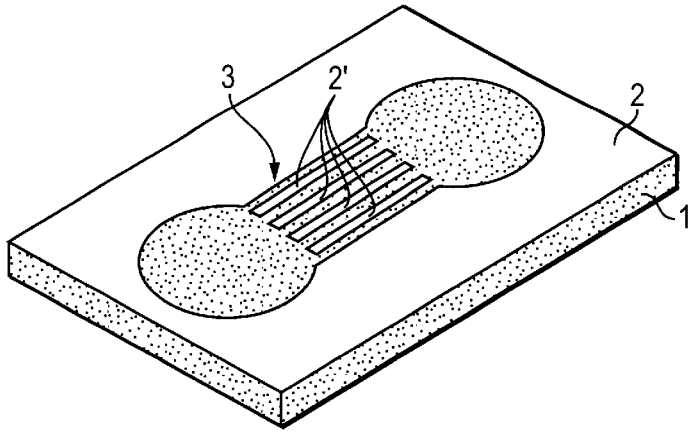
FIG. 7 shows the structure of a resonator in accordance with a fourth embodiment.

FIG. 7 shows the structure of a resonator in accordance with a fourth embodiment. In this example, an electrode 2 having a slot 3 with both ends left open is formed on the upper side of a dielectric substrate 1. Herein, the open portions of the slot are formed by machining round openings in the electrode. Slot lines formed between the two round openings operate as a resonator. Electrode patterns 2' are formed to divide the slot 3 into slot lines. Owing to the structure, the conductor loss occurring in the slot lines is minimized and the efficiency in confining the electromagnetic field is improved.

Figure 8:
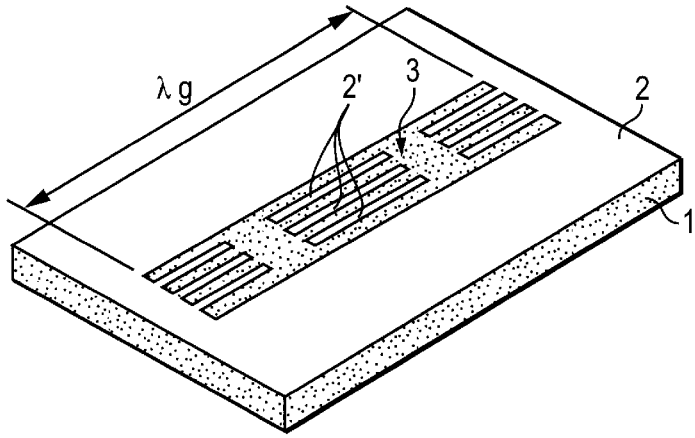
FIG. 8 shows the structure of a resonator in accordance with a fifth embodiment.

FIG. 8 shows the structure of a resonator in accordance with a fifth embodiment. In this example, an electrode 2 having a slot 3 whose length is $\lambda g$ is formed on the upper side of a dielectric substrate 1. However, this example adopts a double-wave resonant mode. Both ends of the slot and the center thereof are therefore designed to be equivalently short-circuited positions. Electrode patterns 2' are formed near the equivalently short-circuited positions so that the slot 3 will be divided into smaller-width slot lines.

Next, an example of a filter will be described as a sixth embodiment with reference to FIG. 9.

Figure 9:
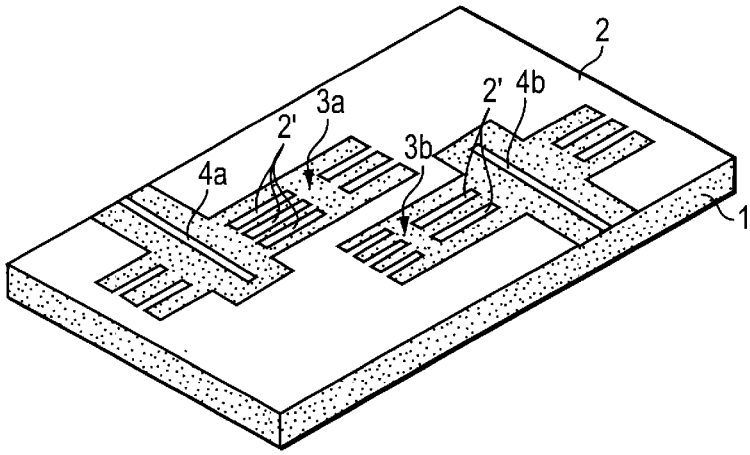
FIG. 9 shows the structure of a filter in accordance with a sixth embodiment.

Referring to FIG. 9, an electrode 2 having slots 3*a* and 3*b* of a predetermined shape machined therein is formed on the upper side of a dielectric substrate 1. The slots 3*a* and 3*b* operate as double-wave resonators having both ends thereof short-circuited. The two slots are located adjacently to each other and are thus coupled to each other. Central electrode patterns 4*a* and 4*b* are formed in directions perpendicular to the longitudinal directions of the slots 3*a* and 3*b* respectively. The central electrode patterns 4*a* and 4*b* and electrode patterns 2' located on both sides of the central electrode pattern constitute a coplanar conductive line. The central electrode patterns 4*a* and 4*b* included in the coplanar lines are magnetically coupled to the associated slots. The coplanar lines are used as signal input and output lines.

Owing to the foregoing structure, the filter acts as a bandpass filter having two resonators coupled to each other.

Figure 10:
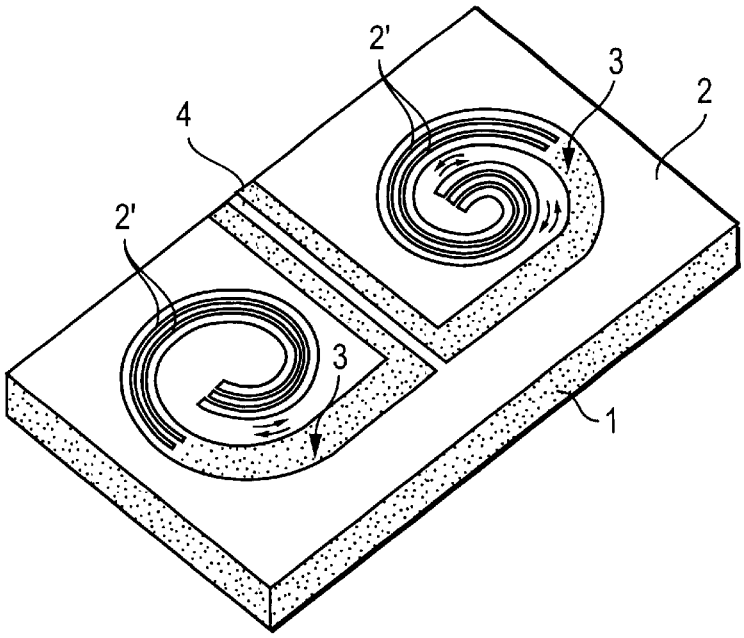
FIG. 10 shows the structure of a filter in accordance with a seventh embodiment.

FIG. 10 shows an example of a filter in accordance with a seventh embodiment. In this example, an electrode 2 having spiral slots 3 machined therein is formed on the upper side of a dielectric substrate 1. One end of each slot is short-circuited. Electrode patterns 2' are extended from the short-circuited ends of the slots by a predetermined length so that the slots will each be divided into smaller-width slot lines. Consequently, the efficiency in confining the electromagnetic field is high. Moreover, unnecessary coupling to outside and unnecessary radiation to outside can be suppressed. In addition, currents flowing along edges of the electrode between adjoining lines of the spiral slot lines are canceled out. Conductor loss occurring at the edges of the electrode between the adjoining slot lines can be minimized. This results in a resonator exhibiting a higher unloaded Q-factor Qo.

The spiral slots are symmetric to each other with respect to a straight line between the spiral slots. A central electrode pattern 4 is extended in a direction perpendicular to the longitudinal directions of the slots between the equivalently open ends of the slots located in the center of the electrode. A coplanar line composed of the central electrode pattern 4 and the electrode 2 extended on both sides of the central electrode pattern is magnetically coupled to the slots operating as resonators. An input/output port defined by the coplanar line is coupled to a predetermined conductive line, whereby this filter acts as a trap for attenuating a signal whose frequency is equivalent to a resonant frequency at which the slots operating as resonators exhibit resonance.

Figure 11:
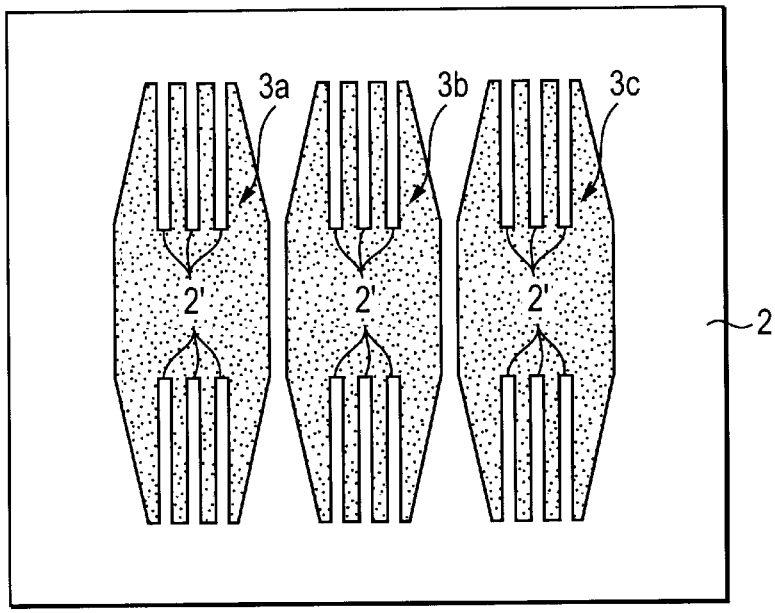
FIG. 11 shows the structure of a resonator in accordance with an eighth embodiment.

FIG. 11 shows the structure of a resonator in accordance with an eighth embodiment. An electrode 2 having slots 3*a*, 3*b*, and 3*c* machined therein is formed on the upper side of a dielectric substrate. Electrode patterns 2' are extended from the equivalently short-circuit ends of the slots so that the slots will each be divided into smaller-width slot lines. The adjoining slots among the three slots operating as resonators are electromagnetically coupled to each other. The electrode patterns 2' work to diminish the spread of the magnetic field. Therefore, the coupling between adjoining slots is weaker than it would be if the adjoining slots were devoid of the electrode patterns 2'. However, since the central portions of the slots in which electric fields are dominant are made thicker as shown in FIG. 11, the electrical coupling between adjoining slots is strong.

An example of a resonator in accordance with a ninth embodiment will be described with reference to FIG. 12A and FIG. 12B.

Figure 12A:
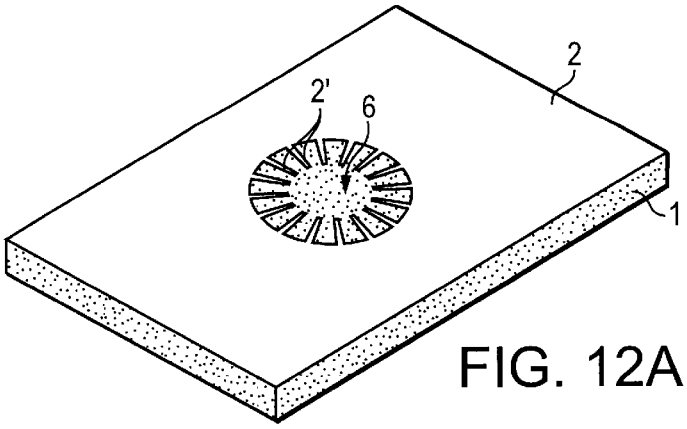
FIG. 12A and FIG. 12B show the structure of a resonator in accordance with a ninth embodiment.
Figure 12B:
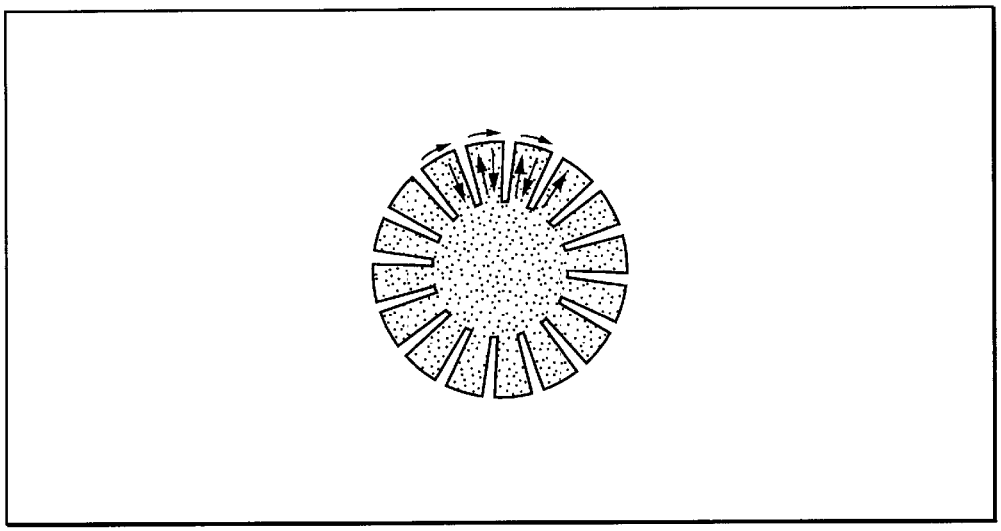

FIG. 12A is a perspective view, and FIG. 12B is a plan view. An electrode 2 having a round opening 6 machined therein is formed on the upper side of a dielectric substrate 1. Electrode patterns 2' are extended inwards (radially) from the periphery of the round opening 6. Owing to the structure, a plurality of slot lines is arranged radially from the center of the opening.

The opening is thus radially divided into the plurality of smaller-width slot lines, whereby the efficiency in confining the magnetic field is improved. Moreover, concentration of currents near a short-circuited end of the opening 6, that is, near the circumference of the opening 6, is alleviated. The direction of a current flowing along one edge of each electrode pattern 2' is, as shown in FIG. 12B, opposite to that of a current flowing along the other edge thereof. Almost no current flows through the electrode patterns 2'. Consequently, a conductor loss is minimized and the unloaded Q-factor Qo exhibited by the resonator is improved.

If the opening 6 shown in FIG. 12A and FIG. 12B were devoid of the electrode patterns 2' and were merely a round opening, the resonator would act as a resonator that utilizes a $TE_{010}$ mode. The resonator having the slot lines arranged radially utilizes a resonant mode different from the $TE_{010}$-mode resonator. The area of the opening 6 in the resonator of FIGS. 12A and 12B is a quarter or less of that in a $TE_{010}$-mode resonator having the same resonant frequency. The resonator can therefore be designed to be much more compact than the $TE_{010}$-mode resonator.

FIG. 6A to FIG. 12B show examples in which no electrode is formed on the lower side of a dielectric substrate. Alternatively, a ground electrode may be formed all over the lower side of the dielectric substrate. Moreover, an electrode having a slot and electrode patterns may be formed on the lower side of the dielectric substrate so that the slot and electrode patterns will be opposed to the slot 3 and electrode patterns 2' on the upper side thereof. This results in a resonator having a planar dielectric transmission line (PDTL).

Figure 13:
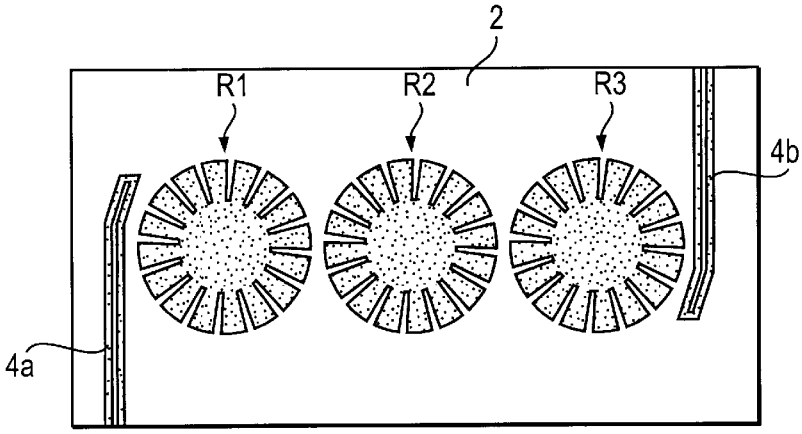
FIG. 13 is a perspective view showing the structure of a filter in accordance with a tenth embodiment.

Next, the structure of a filter in accordance with a tenth embodiment will be described with reference to FIG. 13.

In this example, three resonators R1, R2, and R3 are formed on the upper side of a dielectric substrate. These resonators are slots each of which is the same as the opening shown in FIG. 12A and FIG. 12B, and has a plurality of slot lines arranged radially. Moreover, on the upper side of the dielectric substrate, central electrode patterns 4*a* and 4*b* and an electrode extended around them constitute a coplanar line.

Adjoining resonators of the resonators R1, R2, and R3 are magnetically coupled to each other. Moreover, the central electrode patterns 4*a* and 4*b* are magnetically coupled to the resonators R1 and R3. Consequently, the filter acts as a bandpass filter composed of the three resonators.

Alternatively, openings may be machined in the lower side of the dielectric substrate so that the openings will be opposed to the slots operating as the resonators R1, R2, and R3. As other alternatives, a ground electrode may be formed all over the lower side or no electrode may be formed on the lower side.

Figure 14:
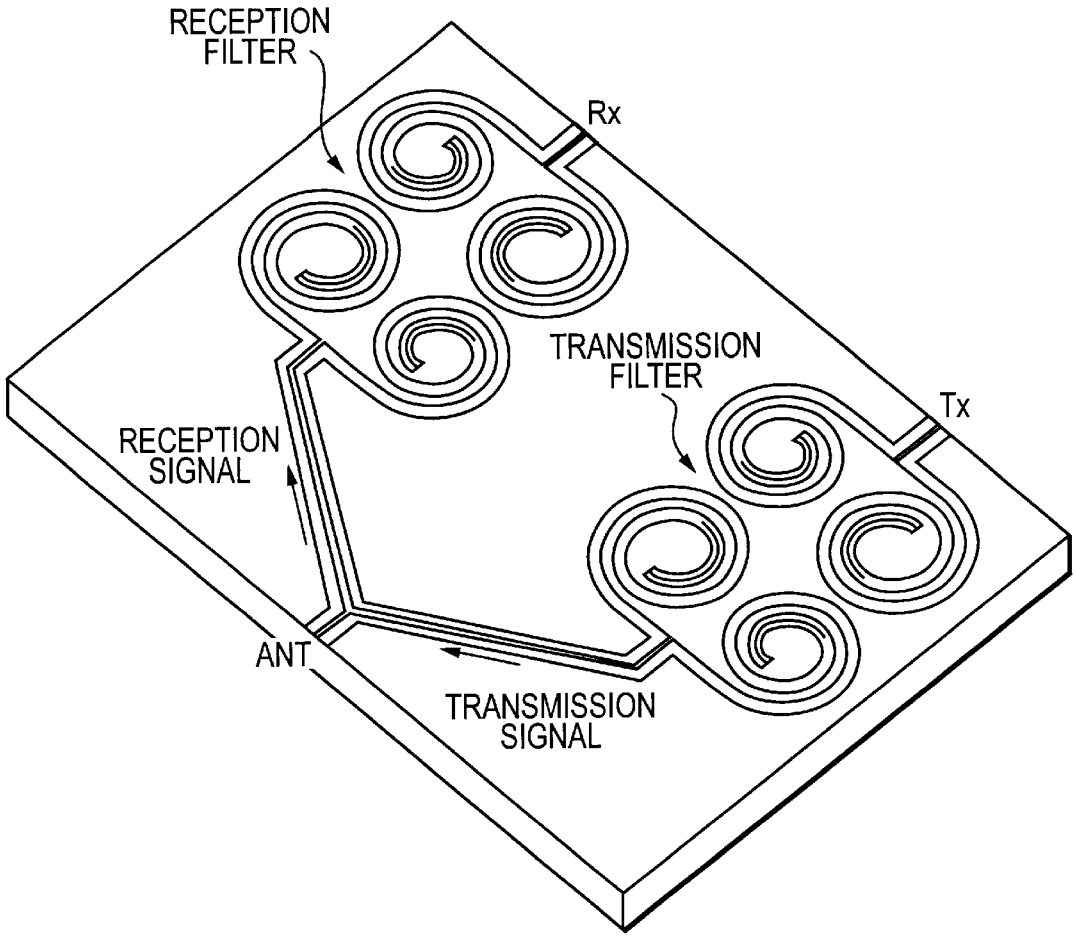
FIG. 14 is a perspective view showing the structure of a duplexer in accordance with an eleventh embodiment.

FIG. 14 shows an example of the structure of a duplexer in accordance with an eleventh embodiment.

Referring to FIG. 14, a transmission filter and a reception filter are realized with dielectric resonators each composed of adjoining resonators each of which has two spiral slots identical to those shown in FIG. 10. The transmission filter is characterized in that it passes a transmission frequency band and attenuates a reception frequency band. The reception filter is characterized in that it passes the reception frequency band and attenuates the transmission frequency band.

In FIG. 14, there are shown a transmission signal input port Tx, a reception signal output port Rx, and an input/output port ANT used in common for transmission and reception. Transmission lines coupled to the ports are coplanar lines. Moreover, a branch circuit is realized with the ANT port, the last-stage (second-stage) resonator of the transmission filter, and the initial-stage (first-stage) resonator of the reception filter which are interconnected over a coplanar line. When a transmission circuit, a reception circuit, and an antenna are connected to the ports Tx, Rx, and ANT respectively, the duplexer is also used as an antenna sharing device for a communication apparatus.

Figure 15:
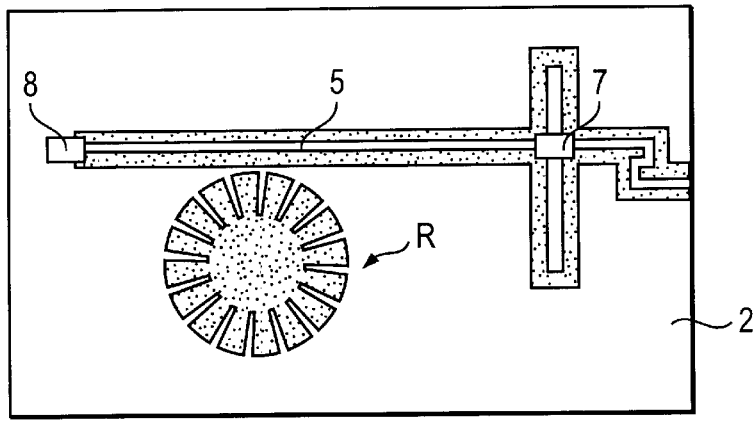
FIG. 15 shows the structure of an oscillator in accordance with a twelfth embodiment.

Next, the structure of an oscillator in accordance with a twelfth embodiment will be described with reference to FIG. 15. Referring to FIG. 15, a resonator R is a slot identical to the opening shown in FIG. 12A and FIG. 12B. A conductive line 5 is extended near the resonator R. The conductive line 5 and an electrode 2 extended on both sides of the conductive line constitute a coplanar line, and the coplanar line is magnetically coupled to the resonator R. One end of the conductive line 5 is terminated with a termination resistor 8, and the other end thereof is coupled to a field-effect transistor (FET) 7. The drain of the FET 7 is grounded. A feedback circuit including the resonator is connected between the drain and gate of the FET 7. The resonator R has a band rejection characteristic. The distance between the resonator R and the FET 7 is set to a suitable value, whereby the oscillator oscillates at the same frequency as the resonant frequency of the resonator R.

Another conductive line may be laid on the dielectric substrate shown in FIG. 15 so that it will be coupled to the resonator R. A variable-reactance device such as a varactor diode may then be connected to the conductive line. A circuit may be included for applying a control voltage to the variable-reactance device. This results in a voltage-controlled oscillator.

As mentioned above, since the resonator R enjoys high efficiency in confining the electromagnetic field, the distance between the conductive line coupled to the FET 7 or the electrode and the resonator R may be decreased. Nevertheless, since the coupling between the conductive line or the electrode and the resonator is weak, the oscillator can be constructed on a limited-size dielectric substrate. The oscillator can be designed to be compact.

Figure 16:
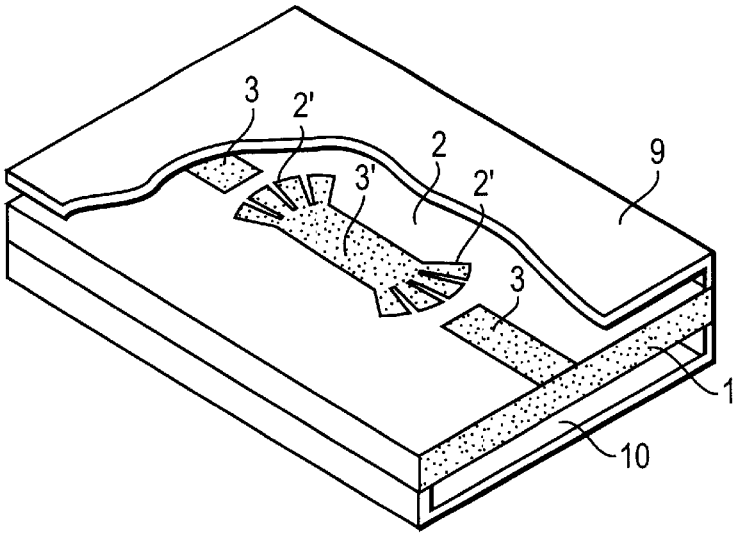
FIG. 16 is a cutaway perspective view showing the structure of a filter in accordance with a thirteenth embodiment.

Next, an example of the structure of a filter in accordance with a thirteenth embodiment will be described with reference to FIG. 16.

In this example, slots 3 and 3' are machined on the upper side of a dielectric substrate 1. Slots having the same shapes as the slots 3 and 3' are machined on the lower side thereof so that they will be opposed to the slots 3 and 3'. Shield plates 9 and 10 are placed above and below the dielectric substrate 1.

The slots 3 machined in the upper and lower sides of the dielectric substrate 1 and the upper and lower shield plates 9 and 10 operate as planar dielectric transmission lines (PDTL). The slots 3' and the upper and lower shield plates 9 and 10 constitute half-wave resonators each including a planar dielectric transmission line (PDTL) and having both ends thereof short-circuited. Electrode patterns 2' are extended from the short-circuited ends of each slot 3' so that the slot 3' will be divided into smaller-width slot lines. Consequently, the filter acts as a filter having resonators, which exhibit a high unloaded Q-factor Qo, connected by slot lines.

The foregoing structure may be adapted to a generally known fin waveguide.

In this case, the filter acts as a filter having resonators connected by transmission lines that are the fin waveguides.

Figure 17:
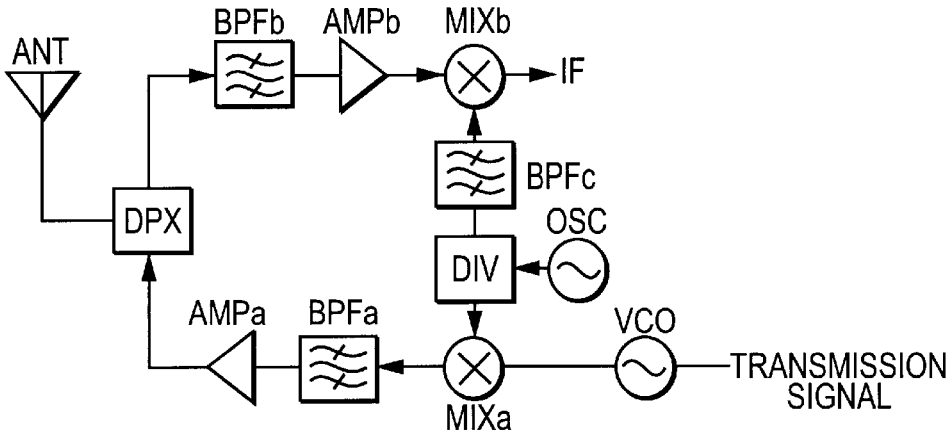
FIG. 17 is a block diagram showing the configuration of a communication apparatus in accordance with a fourteenth embodiment.
Figure 18A:
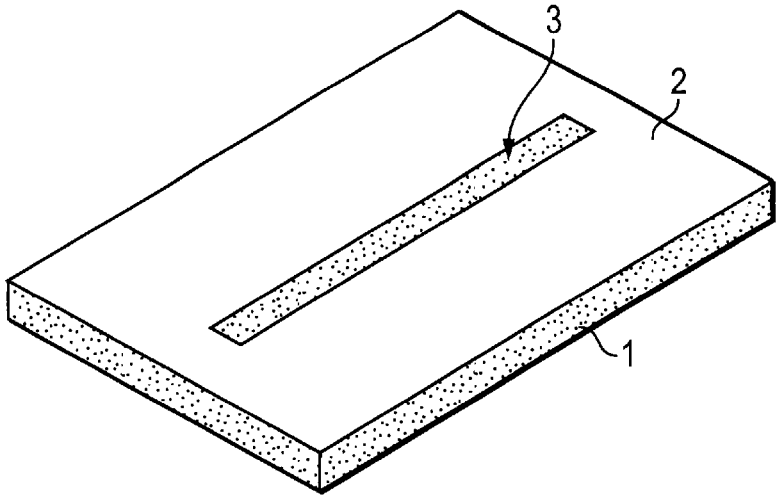
FIG. 18A PRIOR ART
FIG. 18A and FIG. 18B are perspective views showing the structure of a conventional slot-line resonator.
Figure 18B:
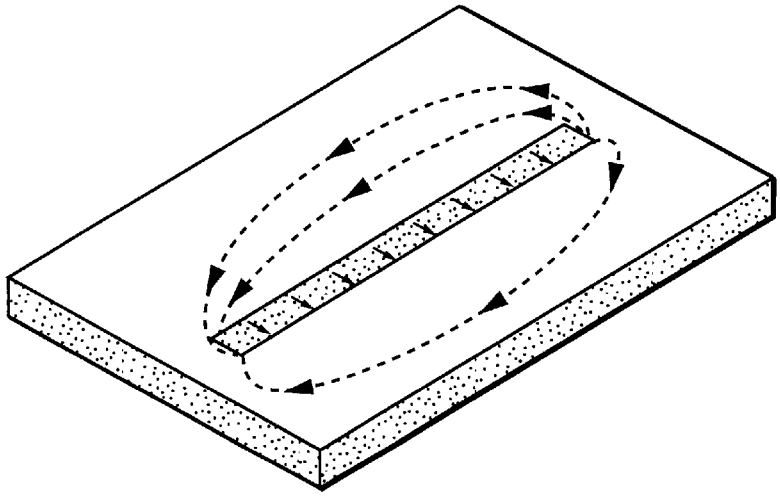
FIG. 18B PRIOR ART

FIG. 17 is a block diagram showing the configuration of a communication apparatus in accordance with a fourteenth embodiment.

Referring to FIG. 17, there are shown a transmission/reception antenna ANT, a duplexer DPX, bandpass filters BPFa, BPFb, and BPFc, amplification circuits AMPa and AMPb, mixers MIXa and MIXb, an oscillator OSC, and a distributor DIV. A voltage-controlled oscillator VCO modulates an oscillation frequency according to a transmission signal (transmission data).

The mixer MIXa mixes a signal modulated by the voltage-controlled oscillator VCO with a signal output from the oscillator OSC and distributed from the distributor DIV. The bandpass filter BPFa passes a component of the mixed output signal output from the mixer MIXa which falls within a transmission band. The amplification circuit AMPa amplifies in power a signal output from the bandpass filter BPFa. The resultant signal is transmitted from the antenna ANT via the duplexer DPX. The bandpass filter BPFb passes a component of a reception signal output from the duplexer DPX which falls within a reception band. The amplification circuit AMPb amplifies a signal output from the bandpass filter BPFb. The mixer MIXb mixes the frequency component, which is output from the oscillator OSC, distributed from the distributor DIV, and output from the bandpass filter BPFc, with the reception signal, and outputs an intermediate-frequency signal IF.

The duplexer shown in FIG. 14 may be adopted as the duplexer DPX shown in FIG. 17. Moreover, the filter shown in FIG. 9, FIG. 10, or FIG. 13 or a filter composed of the resonator shown in any of FIG. 1A to FIG. 12B and a signal input/output unit may be adopted as the bandpass filters BPFa, BPFb, and BPFc. Moreover, a voltage-controlled oscillator realized with the oscillator shown in FIG. 15 is adopted as the voltage-controlled oscillator VCO.

Although the present invention has been described in relation to particular embodiments thereof, many other variations and modifications and other uses will become apparent to those skilled in the art. Therefore, the present invention is not limited by the specific disclosure herein.

What is claimed is:

1. A resonator comprising:

an electrode, in which a slot-shaped opening is defined, said electrode being formed on a dielectric substrate; and electrode patterns formed in at least part of said slot-shaped opening so that said slot-shaped opening is divided into smaller-width slot lines, said electrode patterns having a width effective to suppress an edge effect between said electrode patterns, wherein a direction of a current flowing along one edge of each of said electrode patterns is opposite to a direction of a current flowing along an opposite edge thereof.

2. A resonator according to claim 1, wherein said slot-shaped opening has a spiral shape.

3. A resonator according to claim 1, comprising a juxtaposed plurality of said slot-shaped openings, wherein a portion of each said slot-shaped opening near an equivalently open position thereof has a larger width than another portion of said slot-shaped opening.

4. A resonator according to claim 1, wherein said electrode patterns are formed in portions of said slot-shaped opening which are short-circuited or equivalently short-circuited so that adjoining slot lines into which said slot-shaped opening is divided communicate with a portion of said slot-shaped opening.

5. A resonator according to claim 4, wherein said slot-shaped opening has a spiral shape.

6. A resonator to claim 4, comprising a juxtaposed plurality of said slot-shaped openings, wherein a portion of each slot-shaped opening near an equivalently open position thereof has a larger width than another portion of said slot-shaped opening.

7. A filter comprising a resonator as set forth in any one of claims 1 to 6, and further comprising a signal input/output unit coupled to said resonator.

8. An oscillator comprising a resonator as set forth in any one of claims 1 to 6, and further comprising a reflex amplification circuit coupled to said resonator.

9. A duplexer comprising:

a transmission filter and a reception filter connected respectively between a transmission signal input port and an input/output port used in common for transmission and reception, and between the input/output port and a reception signal output port;

each said filter comprising a resonator according to claim 1; and a signal input/output unit coupled to said resonator.

10. A duplexer according to claim 9, wherein each said slot-shaped opening has a spiral shape.

11. A duplexer according to claim 9, each said resonator comprising a juxtaposed plurality of said slot-shaped openings, wherein a portion of each said slot-shaped opening near an equivalently open position thereof has a larger width than another portion of said slot-shaped opening.

12. A duplexer according to claim 9, wherein said electrode patterns are formed in portions of said slot-shaped opening which are short-circuited or equivalently short-circuited so that adjoining slot lines into which said slot-shaped opening is divided communicate with a portion of said slot-shaped opening.

13. A duplexer according to claim 12, where each said slot-shaped opening has a spiral shape.

14. A duplexer according to claim 12, each said resonator comprising a juxtaposed plurality of said slot-shaped openings, wherein a portion of each said slot-shaped opening near an equivalently open position thereof has a larger width than another portion of said slot-shaped opening.

15. A communication apparatus comprising a high-frequency circuit, said circuit comprising a resonator as set forth in any one of claims 1 to 6.

16. A communication apparatus comprising a high-frequency circuit, said circuit comprising a filter as set forth in claim 7.

17. A communication apparatus comprising a high-frequency circuit, said circuit including an oscillator as set forth in claim 8.

18. A communication apparatus comprising a high-frequency circuit, said circuit including a duplexer as set forth in any one of claims 9 to 14.

* * * * *